United States Patent [19]

Schmid et al.

[11] 4,231,234

[45] Nov. 4, 1980

[54] ASSEMBLY PLATE FOR ASSEMBLING CAM PARTS OF A KNITTING MACHINE

[75] Inventors: Manfred Schmid, Bempflingen; Martin Elsaber, Stuttgart; Manfred Weik, Echterdingen, all of Fed. Rep. of Germany

[73] Assignee: Sulzer Morat GmbH, Bonlanden, Fed. Rep. of Germany

[21] Appl. No.: 910,337

[22] Filed: May 30, 1978

Related U.S. Application Data

[63] Continuation of Ser. No. 728,460, Sep. 29, 1976, abandoned.

[51] Int. Cl.[2] ..... D04B 9/06; D04B 15/34

[52] U.S. Cl. ..... 66/27; 66/57

[58] Field of Search ..... 66/57, 78, 8, 107, 27, 66/54; 269/303, 321 A

[56] References Cited

U.S. PATENT DOCUMENTS

| | | | |
|---|---|---|---|
| 350,794 | 10/1886 | Wilcomb | 66/78 |
| 503,921 | 8/1893 | Williams | 66/57 |
| 933,814 | 9/1909 | Abbott | 66/57 |
| 1,131,583 | 3/1915 | Wilcomb | 66/57 X |
| 1,237,106 | 8/1917 | Scott et al. | 66/57 X |
| 1,311,093 | 7/1919 | Scott | 66/57 |
| 1,785,603 | 12/1930 | Swinglehurst | 66/57 |
| 1,952,928 | 3/1934 | Lawson | 66/8 |
| 2,150,200 | 3/1939 | Zieve | 66/57 X |
| 2,222,287 | 11/1940 | Ford | 66/57 X |
| 2,366,385 | 1/1945 | Comfort | 269/321 A |
| 2,621,807 | 12/1952 | Rendich | 269/321 A |
| 3,463,478 | 8/1969 | Hennessey | 269/321 A |
| 3,463,479 | 8/1969 | Hennessey | 269/321 A |
| 3,795,119 | 3/1974 | Bourgeois | 66/57 X |
| 3,800,561 | 4/1974 | Beuter et al. | 66/57 |
| 3,828,584 | 8/1974 | Bianchi et al. | 66/107 |
| 3,961,499 | 6/1976 | Stepanek et al. | 66/57 X |

FOREIGN PATENT DOCUMENTS

| | | | |
|---|---|---|---|
| 1012021 | 7/1957 | Fed. Rep. of Germany | 66/57 |
| 1398602 | 6/1975 | United Kingdom | 66/57 |
| 1406262 | 9/1975 | United Kingdom | 66/57 |

*Primary Examiner*—Wm. Carter Reynolds

[57] ABSTRACT

A simple and easily manufactured assembly plate for receiving cam parts of a knitting machine in a predetermined position and in which the assembly plate is easily positioned in a knitting machine. The plate is provided with positioning projections, pins or the like which properly position the cam parts and which are formed by simple stamping procedures or by casting or extruding plastic materials.

10 Claims, 10 Drawing Figures

ASSEMBLY PLATE FOR ASSEMBLING CAM PARTS OF A KNITTING MACHINE

This is a continuation of application Ser. No. 728,460, filed Sept. 29, 1976, now abandoned.

The invention concerns an assembly plate for assembling the cam parts of a knitting machine and comprises positioning means for positioning the cam parts.

Fixing and adjustment of the cam parts on their assembly plates and of the assembly plates on the cam base plate of the knitting machine is usually effected by screwing and pinning, which in the assembling of the knitting machine and in the replacement of cam parts involves high labour costs and long stoppage times, and in addition has the disadvantageous consequence that after the adjusting operation, each cam part can be mounted on only a certain assembly plate, or each assembly plate can be mounted on only a certain knitting system, if a repeated adjusting operation is to be avoided. Apart from this, production engineering difficulties arise in providing the cam parts with accurately positioned drill holes, so that frequently, for this reason alone, every replacement operation necessitates a fresh adjustment. It is true that this drawback could partly be avoided by the use of cam switches which, in the case of changes in pattern or kind of knitting, can be adjusted in one of the three possible positions (floating position, tucking position and knitting position). Cam switches, however, result in high production costs and cannot be used in high-system knitting machines because they take up too much space.

It is therefore already known (British Pat. No. 1,352,892) to fix the cam parts on an assembly plate and to machine grooves in the surface of the assembly plate and in the back walls of the cam parts, which grooves extend at right angles to the needle stroke direction and receive arresting elements, fixing the position of the cam parts in the needle stroke direction. For fixing the position of the cam parts in a direction at right angles to the needle stroke direction, in this cam construction further grooves are provided in the cam parts, which fix the position of the cam parts with respect to a sinker part fixed to an adjustable slide fixed in a similar manner to the assembly plate. For fastening all the cam parts to the assembly plate, therefore, screws may be used which are guided with play in the drill holes of the cam parts, so that slight dimensional deviations of these drill holes do not necessitate any addition adjusting work.

In other known cam constructions of this kind (British Pat. No. 1,398,602), the grooves extending at right-angles to the needle stroke direction are provided only in the assembly plate, while, on the contrary, the cam parts are provided with lugs engaging the grooves, which lugs are either machined on the cam parts or may consist of pins, glued or soldered in drill holes in the cam parts.

Finally, it is also already known (British Pat. No. 1,406,262) to fix the assembly plates by similar means three-dimensionally to the cam base plate and secure them with screws, which are passed with clearance through drill holes in the assembly plate.

A disadvantage of the cam constructions described is to be seen especially in the fact that the production costs of both the cam parts and also the assembly plate on the cam base plate are relatively high, because the grooves, lugs or fitted bolt drill holes have to be machined in the cam parts with very high precision if, when mounting the cam parts, the desired spatial arrangement of the edges guiding the needle or jack butts, relatively to each other and to the assembly plate or the cam base plate, is to be ensured without any re-machining. The disadvantage of high production costs thus detracts from the advantage of the simplified replaceability of the cam parts or assembly plates.

For simplifying assembly and replacement of cams, it is also known (DF-Gbm 7,438,082) to carry out the fixing of the cam parts on the cam base plate in the usual manner, but instead to reduce the member of cam parts in that each lock is composed of a number of one-piece cam parts which have a finished guide channel for the needle or jack butts. In this cam construction also, the advantage of simplified assembly and replaceability is opposed by the disadvantage of high production costs.

It is an object of the invention to provide a knitting cam whose cam parts can readily be replaced without thereby increasing the production cost of the knitting cam. A special object of the invention is to design the assembly plate referred to in the foregoing so that no additional positioning means are required on the cam parts themselves for their positioning on the assembly plate.

The invention is characterised in that positioning means provided on the assembly plate which, in the mounted condition of the cam parts, bear against the outer contour of the cam parts.

The invention is accompanied by the advantage that special positioning means for accurately positioning of the cam parts need only be attached to the assembly plate, because the positioning means co-operate with the outer contour of the cam parts, and the outer contour in any event has to be made with precision, because it determines the path of the needle or jack butt in the knitting process and therefore has to satisfy all the technical requirements of knitting.

Preferably, there is at least one cam part which has only one position, in which all the positioning means associated with it lie on its outer contour. It is particularly non-rotatably and non-slidably.

In further development of the invention, the assembly plate has second positioning means serving to fix its position with respect to other elements of the knitting machine. These second positioning means preferably consist of openings or recesses by means of which the position of the assembly plate on the cam base plate of a knitting machine is fixed both in the direction of the needle stroke and also in the direction at right angles thereto. These second positioning means have the advantage that an assembly plate with few handholds can be exchanged for any other assembly plate.

Advantageously, the assembly plate furthermore comprises third positioning means in the form of an opening which is at least partly limited by guide surfaces extending in the needle stroke direction, between which surfaces an adjustable slide carrying at least one knitting cam part is guided. The further advantage is thereby obtained that also the position of the slide or of the adjustable knitting cam part is fixed accurately by the assembly plate in the direction at right angles to the needle stroke direction, so that on adjusting the knitting machine, it is possible to omit the tedious dressing or adjustment of the knitting cam parts, particularly the draw-off parts, which in the case of all known knitting machines is necessary for accurately fixing the knitting points. Apart from this, any assembly plate can be used in any knitting system without the knitting points being displaceable, because all the assembly plates are identical.

The assembly plate preferably consists of a stamped plate in which all the positioning means are formed in the stamping process. From the standpoint of production engineering, this is accompanied by the considerable advantage that only the cam parts need be made by precision work, while for the production of the assembly plates, with all the important positioning means, a simple stamping process is sufficient.

Finally, a further important advantage of the invention is to be seen in the fact that replacement of cam parts in pattern changing can be effected with few manipulations, for example some cam parts being removed from the assembly plate, and being replaced by new cam parts having another contour. Since the assembly plate already has positioning means for all cam parts coming into question, no adjusting work is necessary. A still quicker re-equipment of the knitting machine is possible if the entire assembly plate, which may also have cam parts for a number of knitting machine systems, is removed and is replaced by any other assembly plate which is already provided with the cam parts suitable for the new pattern. In this case also, no adjusting work is necessary.

The invention will now be described more particularly in the following with reference to the accompanying drawings, in which.

Figure 1:
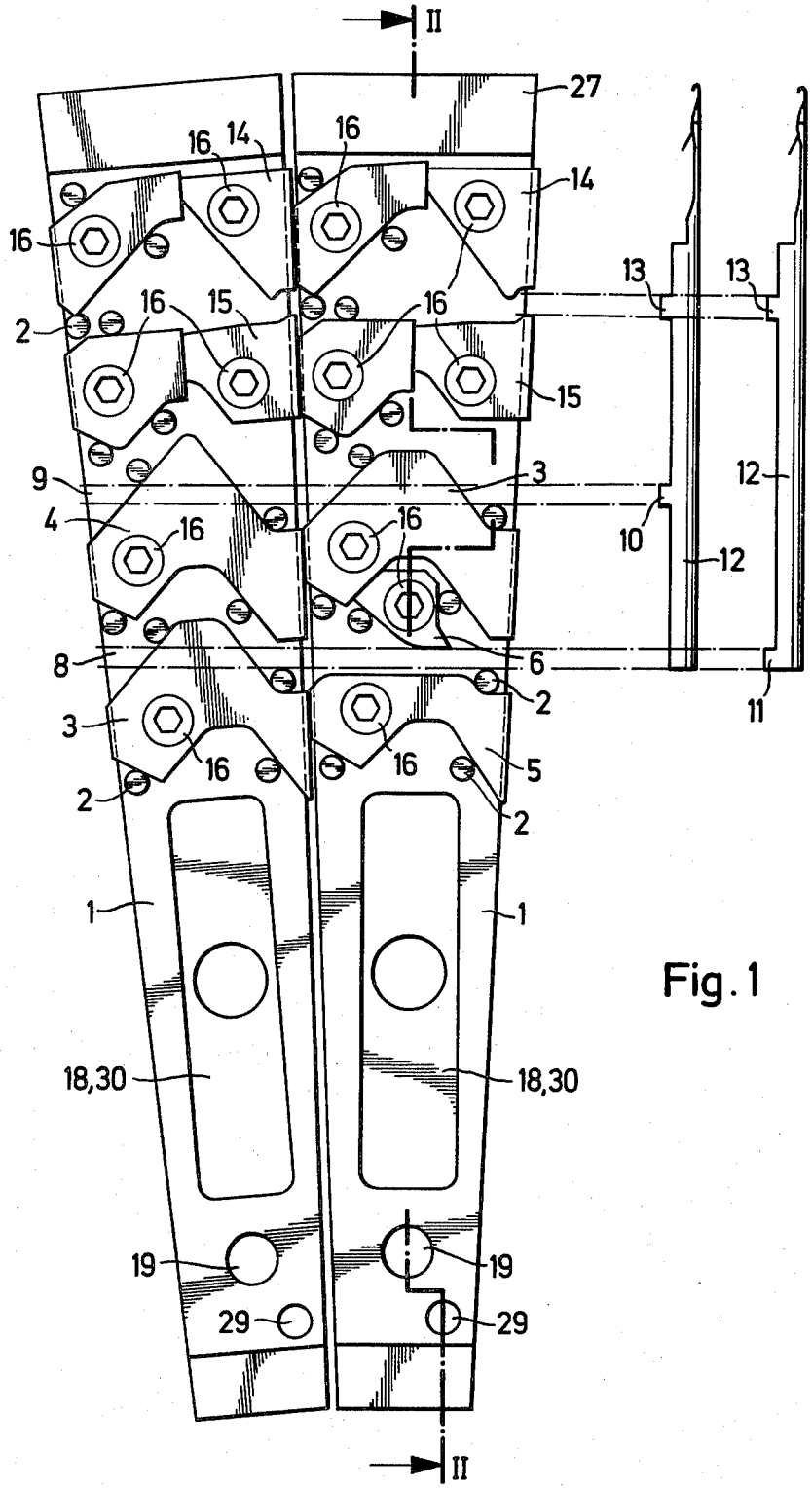
FIG. 1 shows a plan of two assembly plates provided with cam parts for the rib cam of a circular knitting machine.

According to FIG. 1, for each knitting system of a ribbing cam, an assembly plate 1 is provided, consisting of a stamped part, provided in the stamping operation with a plurality of first positioning means in the form of projecting studs 2 arranged on its assembly side. The studs 2 are provided on the assembly plate 1 in such an order that they permit the assembly of a number of different cam parts. The assembly plate has a first surface on which the cam parts are positioned, and the studs 2 project upwardly from that first surface as shown in the Figures. In the left-hand assembly plate 1 in FIG. 1, there is provided in the bottom plane a tuck part 3, and in the plane above that a knitting part 4 has been inserted, while the right-hand assembly plate 1 in the lowermost plane carries a float part 5 and in the plane above it carries a tuck part 3, under which is a securing part 6. The cam parts 3 to 6 form guide channels 8 and 9 for the pattern butts 10 and 11 for knitting needles 12, which are inserted selectively in the grooves of a rib disc, not shown.

In the two top planes of the assembly plate 1, further cam parts, known per se, are provided, these cam parts acting on the knitting butts 13 of the knitting needles 12. Of these cam parts, in particular, reference should be made to the draw-off parts 14 and the cam parts 15 below them, which in known manner produce looping and are fixed to a slide which is movable in the direction of the needle stroke. As follows from FIG. 2, the thickness of all the cam parts is adequately greater than the height of the studs 2 so that the butts 10, 11 and 13, sliding on the outer contours of cam parts cannot come into contact with the studs 2.

As may be gathered from FIG. 1, all cam parts, with the exception of cam parts 14 and 15, are positioned both in the needle stroke direction and in the direction at right angles thereto by the studs 2 bearing against their outer contour, while in addition, for positioning of the securing cam part 6, the application of this cam part to the tuck part 3, situated above, is utilised. For fixing the lock parts to the assembly plate 1, screws 16 (FIG. 2) may therefore be used, these screws projecting with slight clearance through suitable holes drilled in the cam parts so that these drilled holes can be made with relatively large tolerances in the assembly plate 1 with respect to the corresponding screwthreaded holes in the assembly plate 1.

In the lower part of each stamped assembly plate 1 is a rectangular opening 18 and a circular opening 19, both of which are part of a second positioning means and are aligned in their position and distance very accurately relative to the studs 2 and therefore also relative to cam parts positioning by the said studs and serve for fixing the assembly plate 1 to a cam base plate 21.

Figure 2:
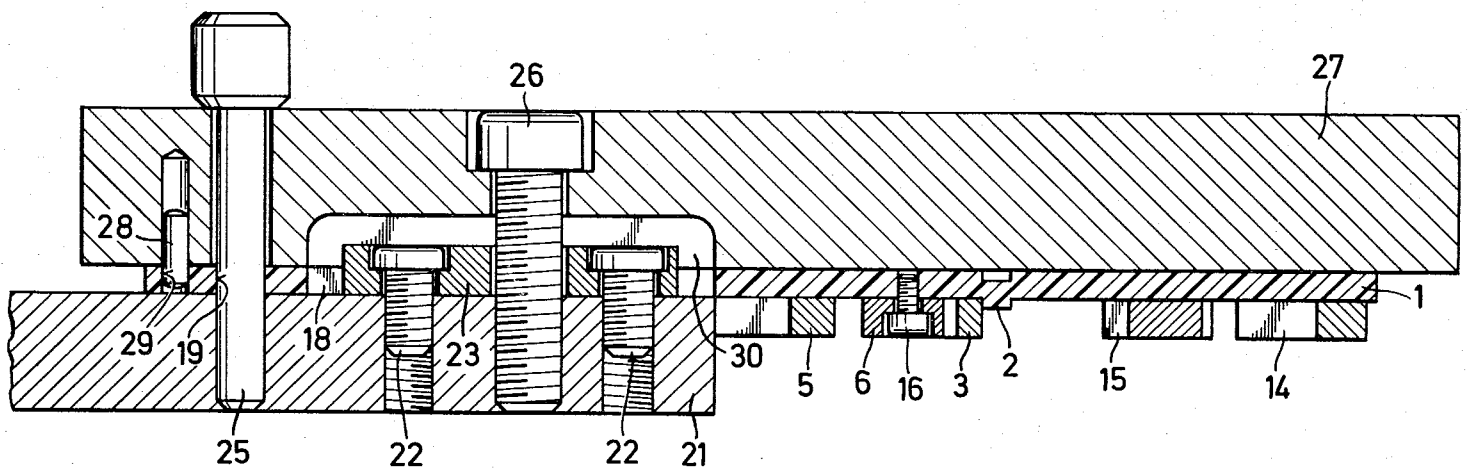
FIG. 2 shows a section along the lines II—II of FIG. 1.

According to FIG. 2, there is secured to the cam base plate 21 by means of screws 22 for each assembly plate a fitting or locating means 23, having a width corresponding exactly to the width of the opening 18 thus fixing the position of the assembly plate 1 to the cam base plate 21 in the direction at right angles to the needle stroke direction. On the contrary, in the direction of the needle stroke, positioning of the assembly plate 1 to the cam base plate is effected by means of a fitting bolt 25, which is inserted without play in the opening 19. A screw 26 is provided for fixing the assembly plate 1 to the cam base plate 21 which screw can project through a fourth positioning means in the form of the fitting spring 23.

The back of the assembly plate may be covered by a segment 27, whose position with respect to the assembly plate is fixed by pins 28 projecting into the segment 27 without play through openings 29, provided in the assembly plate 1. With the use of the segment 27, the fitting pin 25 and the screw 26 project, entirely or partly and with play, also through the segment 27. Fixing of the assembly plate 1 to the segment is effected by means of screws, not shown, which project with play through the assembly plate 1. In the region of the locating means 23, the segment 27 has an opening or recess 30.

Figure 4:
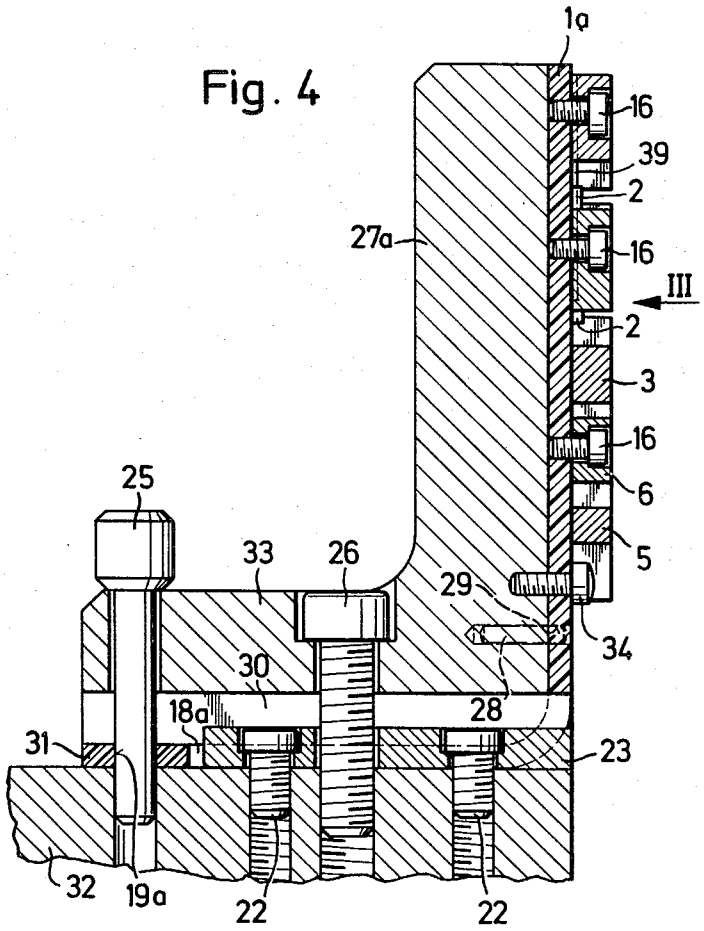
FIGS. 4 to 6 are sections on the lines IV—IV, V—V and VI—VI of FIG. 3.
Figure 3:
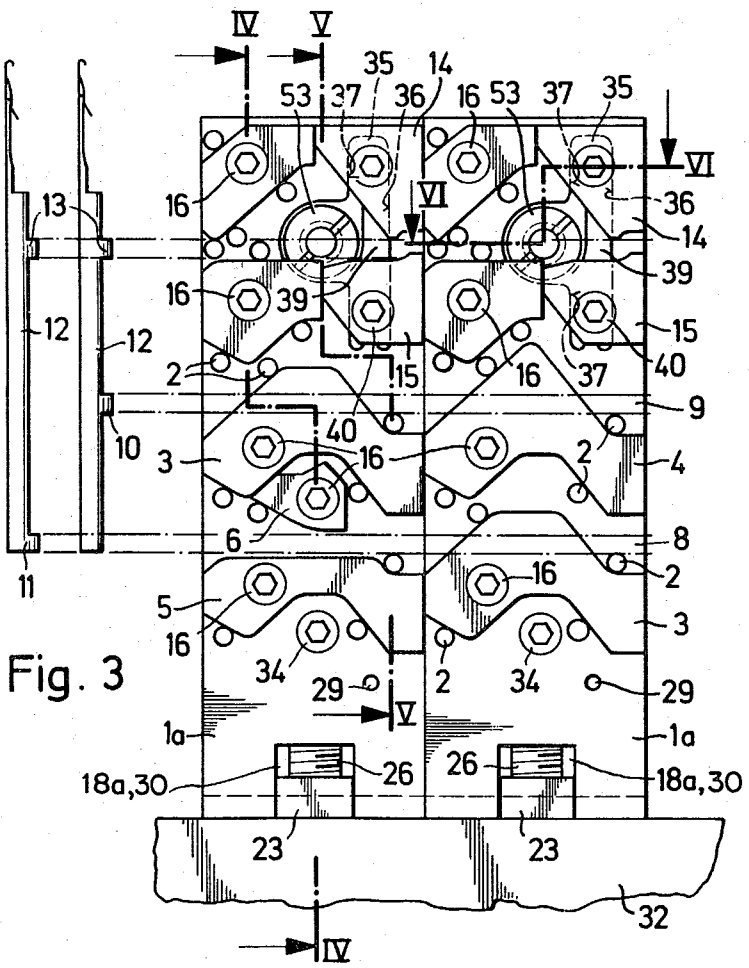
FIG. 3 is a plan of two assembly plates provided with cam parts for the cylinder cam of a circular knitting machine.
Figure 5:
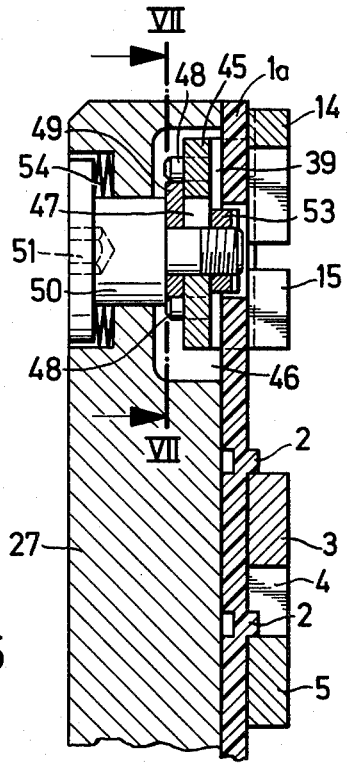
Figure 6:
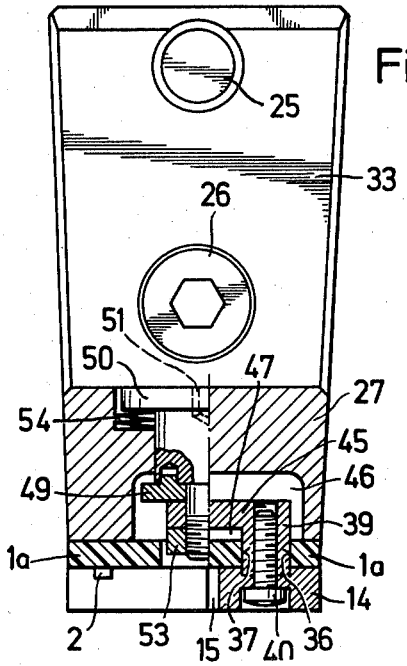

FIGS. 3 and 4 show assembly plates 1*a* for a cylinder cam of a circular knitting machine, identical parts being provided with the same reference numerals. In contrast to the embodiment of FIGS. 1 and 2, the openings 18*a* and 19*a* are located in a lower part 31 of the assembly plate 1*a* which is bent out at a right angle from the upper part of the assembly plate 1*a*, since the assembly plate of the cylinder cam has to be fixed to a horizontal cam base plate 32, to which the locating means 23 are also fixed. Corresponding to the assembly plate 1*a*, the segment 27*a* also has, fixed to its back by means of pins 28, a lower part 33 bent out at a right angle, through which the fitting bolt 25 and the screw 26 project. In this embodiment also, the position of the cam parts with the exception of cam parts 14 and 15 relative to the cam base plate 32 is fixed in both directions by studs 2, openings 18*a* and 19*a*, locating means 23 and fitting bolt 25. Screws 34 are provided for fastening the segment 27*a* to the assembly plate 1*a*.

FIGS. 3 and 5 to 7 show details of an adjusting mechanism for the knitting cam parts 14 and 15, which mechanism may also be provided in the embodiment example of FIGS. 1 and 2. According to FIG. 3, there is provided in the assembly plate 1*a* a third positioning means in the form of an opening 35 which on the right hand position has an oblong shape, and is bounded above and below by rectilinear guide surfaces 36 and 37 extending in the needle stroke direction, while on the left-hand portion it has a substantially circular form. Guided in the oblong part of the opening 35 is a slide 39, whose width correponds exactly to the distance between the two guide surfaces 36 and 37, and whose length is somewhat less than the length of the oblong part of the opening 35, so that it can be shifted in this oblong part in the needle stroke direction, and in the direction at a right angle to the needle stroke direction it is fixed without play in its position relative to the assembly plate. Secured to the slide 39 by means of screws 40 are the cam parts 14 and 15 and in the back of each of these cam parts is machined a slot which in the assembled state of the cam parts, receives with accurate fit the upper part of the slide 39 projecting through the opening 35 (FIG. 6), so that the knitting cam parts 14 and 15 are positioned exactly in the direction at a right angle to the needle stroke direction with respect to the slide 39 or the assembly plate 1*a*, even if the screw 40 projects with play through the drill hole provided in the cam parts.

Figure 7:
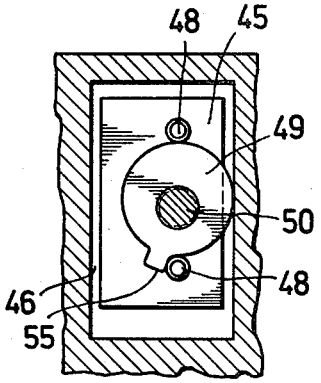
FIG. 7 is a fragmentary section on the line VII—VII of FIG. 5.

Formed at a right angle on the back of the slide 39 is a guide plate 45, which projects into a recess 46 of the segment 27*a*, has an oblong middle opening 47 and carries two backwardly projecting pins 48, between which is arranged a cam disc 49 (FIG. 7). As shown more particularly in FIG. 6, the cam disc 49 is connected rotationally fast by means of a pin connection to the wide middle portion of an adjusting screw 50, which projects through a central offset drill hole of the segment 27*a*, and the rearwardly projecting head of which is provided with a hexagonal hole 51 or the like, so that it can be rotated from the back of the segment 27*a*. On its other end, the adjusting screw 50 has first a portion of reduced diameter on which the cam disc 49 is mounted and which is adjoined by a screwthreaded portion, which projects through the central opening 47 and on which a nut 53 is screwed from the other side of the guide plate 45. Finally, pushed on the wide central part of the adjusting screw 50 is at least one cup spring 54 supported between the head of the adjusting screw and a wall section of the offset drill hole of segment 27*a*, and thus prestresses the adjusting mechanism comprising the slide 39, guide plate 45, cam disc 49, adjusting screw 50 and nut 53, such that the knitting cam parts 14 and 15 always bear on the assembly plate 1*a*, independently of the rotary position of the nut 53.

The cam disc 49 is preferably formed as a constant thickness element, i.e. it is so formed that movement of the slide 39 is proportional to the angle of rotation of the adjusting screw 50 and both pins 48 in each rotation position of the cam disc 49 bear tightly against this disc. Furthermore, the cam disc may be provided with a stop 55 which bears against the pins 48 and fixes the maximum positions of the slide 39. Assembly of part of a rib cam or cylinder cam with an assembly plate 1*a* may be carried out as follows:

The assembly plate 1*a* is first laid on the front side of the segment 27*a* and is aligned on the latter, the exact relative position of the offset drill hole of the segment 27*a* and of the openings 29 provided in the assembly plate 1*a* being fixed, because the offset drill hole fixes with slight play the position of the slide 39 in the direction at a right angle to the needle stroke direction. A corresponding number of bottomed holes are then drilled in the segment 27*a* through the openings 29 provided in the assembly plate and the latter is taken off the segment again. The different parts of the adjusting mechanism for the slide 39 are then joined together in the offset drill hole or opening 46 of the segment 27*a*, whereupon the assembly plate 1*a* is placed on the front of the segment so that the slide 39 lies in the elongated part of the opening 35. After insertion of the pins 28 in the openings 29 and the previously formed drill holes in the segment 27, the assembly plate is then screwed fast to the segment 27*a*. The selected cam parts are then positioned between the studs 2 and are screwed fast to the assembly plate. The opening 18 of the assembly plate is then pushed on the locating means 23, previously fixed to the cam base plate 21 or 32, and the cam plate is brought into the desired position in the needle stroke direction. Then, through the opening 19, a hole is drilled in the cam base plate 21 or 32, the fitting bolt 29 is inserted and the segment 27*a* including the assembly plate 1 is finally screwed fast to the cam base plate.

After this work has been carried out, the locating means 23 fixes the position of the assembly plate in a direction at a right angle to the needle stroke direction, and the fitting bolt 25, on the contrary, fixes the position of the assembly plate in the needle stroke direction. The replacement of a cam may be effected, therefore, by screwing on a suitably prepared segment 27*a*, including the assembly plate 1*a* and the cam parts selected according to the new pattern, no adjusting work having to be done because all the assembly plates have exactly the same shape owing to the stamping process. Alternatively, it is possible to dismantle only one segment including assembly plate and to insert new cam parts in the assembly plate, for which also no adjusting work is necessary, because the outer contours of all cam parts having the same function are also exactly identical.

Figure 8:
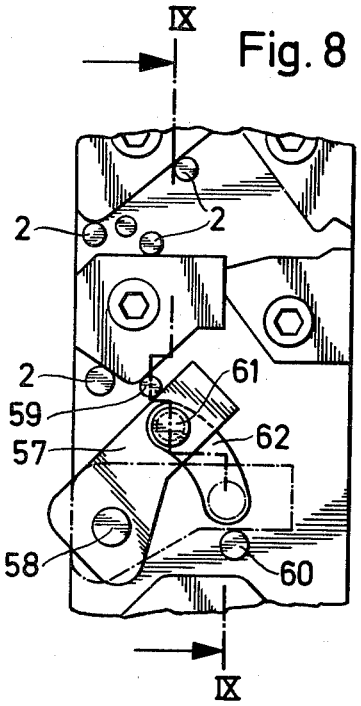
FIG. 8 is a plan of an assembly plate provided with a switch.
Figure 9:
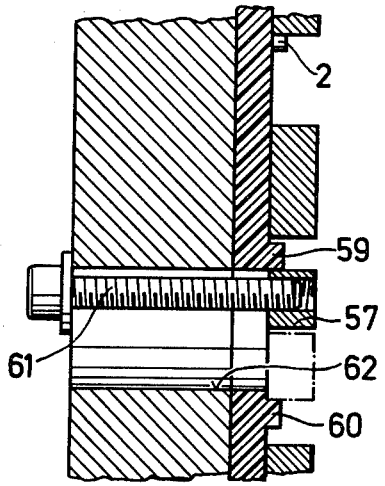
FIG. 9 is a section on the line IX—IX of FIG. 8.

In the embodiment shown in FIGS. 8 and 9 cam parts corresponding to FIG. 1 are provided, being positioned by means of studs 2. In addition, a lock part 57 is provided, having on its underside a fitting drill hole, into which after assembly a raised stud 58 of the assembly plate projects, so that the cam part 57 can be rotated about the stud 58. Furthermore, two other raised studs 59 and 60 are provided on the assembly plate and serve for positioning the slot part 57 in two possible positions, one of which is shown in FIG. 8 in solid lines, while the other position is indicated by dot-dash lines. Fixing of the lock part 57 is by means of a fixing screw 61 passing through an elongated slot 62 of the assembly plate, so that the cam part 57 can be brought from one position to the other without completely undoing the fixing screw 61.

Figure 10:
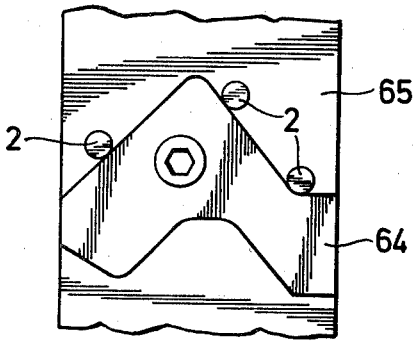
FIG. 10 shows an assembly plate according to another embodiment of the invention.

In the embodiment of FIG. 10, raised studs 2 are also provided for positioning a cam part 64 to an assembly plate 65. These studs are so arranged that there is only one position of the cam part in which all studs bear simultaneously on the outer contour of cam part 64 when the fastening screw is inserted into the associated screwthreaded hole of the assembly plate. Although, therefore, unlike the embodiment shown in FIG. 1, the studs 2 do not hold the cam parts in a non-rotatable or non-slidable manner, respectively, but nevertheless definitely fix that position of the cam part 64 which it is to occupy in the assembled condition. Fastening of cam part 64 is effected by means of a fastening screw inserted with play.

The invention is not limited to the embodiments described. Instead of a respective assembly plate for each knitting system, assembly plates can be provided, for example, which are associated with a plurality of knitting systems and therefore simplify still further the equipping of a knitting machine for another pattern. The number of studs on each assembly plate is also in itself optional, provided only that these studs are so arranged that they can position all cam part types exactly in their position with the exception of cam parts 14 and 15 and the cam part 6. Furthermore, the segment 27, described with reference to the drawings, may be omitted, because this segment only serves to cover the assembly plate and to receive the adjusting mechanism for the slide 59 of the sinker. Modifications of the segment and adjusting mechanism are also possible in any convenient manner, provided care is taken to ensure that the knitting cams, like the other cam parts, are fixed in the direction at a right angle to the needle stroke direction through an opening or the like provided in the assembly plate and can only be adjusted in the needle stroke direction. Finally, the invention may be applied with advantage also in flat knitting machines, in which case the assembly plates are fixed to the cam carrier accommodated in the carriage.

The assembly plate preferably consists of a stamped metal plate having a hardened surface, but alternatively also a suitable plate made by a precision casting process, or a plastics plate may be used, which may also be made in some other manner, for example by an injection moulding process. The cam parts may also consist of stamped parts.

Finally, in the embodiment according to FIGS. 3 to 7, that part 31 of the assembly plate 1*a*, which is bent away at a right angle, may be omitted. In this case, positioning of the assembly plate 1*a* with respect to the cam base plate 32 is effected solely by means of the part 33 of the segment 27.

The studs 2 of circular cross-section shown in the drawings may be replaced by any other holding means having the same effect. For example, projections of any kind are conceivable, which are arranged in raised manner on the assembly plate 1*a*. Alternatively, however, a countersunk portion or recess may also be stamped in the plate, the outer contour of the said countersunk portion being adapted to the contour of the cam parts to be inserted, such that all insertable cam parts lie at least partly against the boundary walls of the countersunk portion. As shown particularly by FIG. 1, the three cam parts 3,4 and 5 could be of identical construction in their right- and left-hand lower parts and therefore all held non-slidably in an opening corresponding to the contour of the largest cam part 4. In these possible embodiments also, no additional positioning means need be provided on the cam parts. Even a through-going opening in the assembly plate is conceivable, in which case the cam parts may be fixed to the segments 27.

We claim:

1. An assembly plate mounted on a cam base plate for the stationary and interchangeable assembling of at least one cam part of a group of cam parts of a knitting machine at at least one location on the assembly plate, said group including a plurality of cam parts of the same or different type, each cam part having an outer contour and one predetermined position at said location, and the assembly plate having a first surface and attaching means for mounting said cam parts on said assembly plate first surface and a plurality of first positioning means for association with said cam parts, said first positioning means being raised portions of the assembly plate which are integral and unitary with such plate, said first positioning means being located essentially entirely on said assembly plate first surface about the outer contour of each of said cam parts with respect to said attaching means for non-rotatably and non-slidably maintaining said cam parts in position to accurately orient said cam parts into a selected needle guidance position, at least one cam part having only one position on said assembly plate in which all of said first positioning means associated with such one cam part bear against the outer contour of such one cam part, said first positioning means having a height above said first surface of the assembly plate less than the height of the cam parts so that butts of a needle assembly will contact only the cam parts and will not come into contact with said first positioning means, said assembly plate including means for mounting said plate on the cam base plate.

2. An assembly plate according to claim 1, said assembly plate being provided with a least one screwthreaded hole and wherein said attaching means comprises at least one screw, each cam part having at least one hole for receiving with play said screw such that in the assembled condition of said at least one cam part said screw projects with play through said hole of said at least one cam part and into the screwthreaded hole in said assembly plate for fastening said at least one cam part in said predetermined position.

3. An assembly plate according to claim 1, further having at least one second positioning means being accurately aligned to said first positioning means and serving to define the position of the assembly plate and thereby also of the cam part at the knitting machine.

4. An assembly plate according to claim 1, in which said assembly plate is associated with a slide member and said assembly plate further has at least one third positioning means serving to position the slide member within the assembly plate in a first direction, said slide member being movably mounted in at least one second direction by said third positioning means, and at least one cam part being fastened to the slide member.

5. An assembly plate according to claim 3, further including at least one fitting means fixed to said knitting machine, wherein said second positioning means comprises a rectangular opening in said assembly plate the width of the opening measured in a first direction being equal to the width of the at least one fitting means such that said assembly plate may be moved on said fitting means in a direction perpendicular to said first direction and is positioned by said fitting means in said first direction.

6. An assembly plate according to claim 1, wherein said knitting machine has a plurality of knitting systems and wherein the assembly plate includes a plurality of said first positioning means for positioning a number of cam parts corresponding to at least two of said plurality of knitting systems.

7. A metal assembly plate mounted on a cam base plate for assembling a plurality of cam parts of a knitting machine and for being mounted on said knitting machine, the assembly plate including a first surface and attaching means for mounting cam parts on said assembly plate first surface, at least one cam part being stationarily mountable and at least one cam part being movably mountable by means of at least one slide member, each cam part having an outer contour, wherein the assembly plate comprises first positioning means for positioning said stationary cam part in one predetermined position on the assembly plate by bearing against the outer contour thereof, said first positioning means being stamped raised portions of the assembly plate which are integral and unitary with such plate, said first positioning means being located essentially entirely on said assembly plate first surface about the outer contour of said cam part with respect to said attaching means for maintaining said cam part in position to accurately orient said cam part into a selected needle guidance position, said stationary cam part having only one position on said assembly plate in which all of said first positioning means associated with such one cam part bear against the outer contour of such one cam part, said first positioning means having a height above said first surface of the assembly plate less than the height of the cam parts so that butts of a needle assembly will contact only the cam parts and will not come into contact with said first positioning means, said assembly plate including means for mounting said plate on a cam base plate, second positioning means being accurately aligned to said first positioning means and serving to define the position of the assembly plate and thereby also of the cam parts on the knitting machine and third positioning means being accurately aligned to said first positioning means for positioning the slide member on the assembly plate, said second and third positioning means and the assembly plate being formed by a stamping process.

8. An assembly plate according to claim 1, wherein said assembly plate includes a bent part at an angle and further comprising a second positioning means.

9. An assembly plate according to claim 1, wherein said first positioning means are stamped.

10. An assembly plate according to claim 5, wherein said second positioning means further comprises a circular opening which receives with snug fit a fitting bolt, serving to position the assembly plate on said knitting machine in said second direction.

* * * * *